US005223764A

United States Patent [19]

Chen

[11] Patent Number: 5,223,764

[45] Date of Patent: Jun. 29, 1993

[54] ELECTRON GUN WITH LOW VOLTAGE LIMITING APERTURE MAIN LENS

[75] Inventor: Hsing-Yao Chen, Barrington, Ill.

[73] Assignee: Chunghwa Picture Tubes, Ltd., Taoyuan, Taiwan

[21] Appl. No.: 804,298

[22] Filed: Dec. 9, 1991

[51] Int. Cl.[5] ..... H01J 29/48; H01J 29/51

[52] U.S. Cl. ..... 313/414; 313/448; 315/15

[58] Field of Search ..... 313/414, 448; 315/15

[56] References Cited

U.S. PATENT DOCUMENTS

| | | | |
|---|---|---|---|
| 2,070,319 | 2/1937 | Rudenberg | 250/27.5 |
| 2,072,957 | 3/1937 | McGee | 250/27.5 |
| 2,111,941 | 3/1938 | Schlesinger | 250/27.5 |
| 2,128,581 | 8/1938 | Gardner | 250/27.5 |
| 2,135,941 | 11/1938 | Hirmann | 250/27.5 |
| 2,185,590 | 1/1940 | Epstein | 250/155 |
| 2,202,631 | 5/1940 | Headrick | 250/163 |
| 2,209,159 | 7/1940 | Gorlich et al. | 250/27.5 |
| 2,213,688 | 9/1940 | Broadway et al. | 250/160 |
| 2,217,168 | 10/1940 | Hefele et al. | 250/27 |
| 2,229,766 | 1/1941 | Nicoll et al. | 250/27 |
| 2,260,313 | 10/1941 | Gray | 250/27 |
| 2,888,606 | 5/1959 | Beam | 315/16 |
| 3,798,478 | 3/1974 | Say | 313/70 |
| 3,887,830 | 6/1975 | Spencer | 313/443 |
| 3,919,588 | 11/1975 | Parks et al. | 315/14 |
| 3,928,784 | 12/1975 | Weijland | 313/389 |
| 4,009,410 | 2/1977 | Pommier et al. | 313/411 |
| 4,075,533 | 2/1978 | Janko | 313/424 X |
| 4,218,635 | 8/1980 | Bedard et al. | 315/17 |
| 4,268,777 | 5/1981 | van Roosmalen | 315/1 |
| 4,388,556 | 6/1983 | Rao | 315/14 |
| 4,467,243 | 8/1984 | Fukushima et al. | 313/448 |
| 4,540,916 | 9/1985 | Maruyama et al. | 315/16 |
| 4,549,113 | 10/1985 | Rao | 315/14 |
| 4,628,224 | 12/1986 | Collins et al. | 313/414 |
| 4,724,359 | 2/1988 | Roussin | 315/15 |
| 4,764,704 | 8/1988 | New et al. | 313/414 |
| 4,886,998 | 12/1989 | Endo | 313/414 |
| 5,036,258 | 7/1991 | Chen et al. | 313/414 X |
| 5,066,887 | 11/1991 | New | 313/414 |
| 5,142,189 | 8/1992 | Sugahara et al. | 313/414 |

*Primary Examiner*—Sandra L. O'Shea
*Attorney, Agent, or Firm*—Emrich & Dithmar

[57] ABSTRACT

A limiting aperture disposed in a relatively low voltage and electrostatic field-free region in the main focusing lens portion of an electron gun in a cathode ray tube (CRT) provides reduced electron beam spot size and improved video image contrast and purity in the CRT's display screen. The generally circular limiting aperture is disposed on the axis of the electron gun and within a charged electrode, or grid, within the main focusing lens. The cylindrically shaped, charged grid is elongated along the gun axis and includes generally circular recesses in facing surfaces thereof, which recesses are also disposed on the gun axis and separated by an inner partition defining the limiting aperture. The charged grid is maintained at a voltage $V_G$, with $V_G \leqq 0.12\ V_A$, where $V_A$ is the CRT's anode voltage. With the limiting aperture recessed within the elongated charged electrode, the electrostatic field is essentially zero at the limiting aperture where outer, peripheral electrons in the electron beam are intercepted and removed from the beam for limiting electron beam spot size. The low voltage of the limiting aperture-bearing grid substantially reduces the possibility of secondary electrons reaching the display screen. Most of the secondary electrons are absorbed by the succeeding high voltage grid.

30 Claims, 6 Drawing Sheets

ELECTRON GUN WITH LOW VOLTAGE LIMITING APERTURE MAIN LENS

FIELD OF THE INVENTION

This invention relates generally to electron guns for forming, accelerating and focusing an electron beam such as in a cathode ray tube (CRT) and is particularly directed to the beam accelerating and focusing region of an electron focusing lens in a CRT and an arrangement for providing an electron beam with a small, well-defined spot size.

BACKGROUND OF THE INVENTION

Electron guns employed in television CRTs generally can be divided into two basic sections (1) a beam forming region (BFR), and (2) an electron beam focus lens for focusing the electron beam on the phosphor-bearing screen of the CRT. Most electron beam focus lens arrangements are of the electrostatic type and typically include discrete, conductive, tubular elements arranged coaxially and having designated voltages applied to each of the elements to establish an electrostatic focusing field. A monochrome CRT employs a single electron gun for generating and focusing a single electron beam. Color CRTs typically employ three electron guns with each gun directing a respective focused electron beam on the CRT phosphorescing faceplate to provide the three primary colors of red, green and blue. The electron guns are frequently arranged in an inline array, or planar, although delta gun arrays are also quite common. The present invention has application in both monochrome and multi-electron beam color CRTs. A sharply focused electron beam having a small spot size provides a video image having high definition. In order to reduce beam spot size, limiting apertures of small size have been incorporated in the electron gun. These prior limiting aperture approaches have met with only limited success because of three sources of performance limitations.

In the conventional design, the limiting aperture is typically disposed in the focus voltage grid. In this region, the electrons typically have kinetic energies on the order of a few kilovolts (KV) which causes secondary electron emission at the focus grid. The secondary electrons generally land on the CRT screen causing loss of contrast and/or loss of purity in a color which generally appears as a haze surrounding a video image. Because the electron beam typically has a large cross-section in the beam focus region, the focus grid limiting aperture is also relatively large. This increases the likelihood of the secondary electrons being incident on the screen. There is usually no grid with a voltage higher than the limiting aperture and lower than the anode to absorb the secondary electrons before they reach the screen and cause loss of resolution. A second problem arises from the electrons intercepted by the limiting aperture flowing through the resistor chain toward the CRT's anode. This electron current causes focus voltage shift and a resulting de-focusing of the electron beam. The third problem also arises from the energetic electrons incident upon the focus voltage grid about the limiting aperture. Because the intercepted electrons in this high voltage region of the electron gun have high kinetic energy (the CRT gun typically has a focus voltage of a few thousand volts), the intercepted high energy electrons release their kinetic energy at the aperture region causing a substantial increase in the temperature of the focus voltage grid, which in some cases becomes vaporized before this energy can be dissipated. These three problems have limited prior art attempts to reduce electron beam spot size by means of a small aperture in the electron gun.

The present invention overcomes the aforementioned limitations of the prior art by providing a relatively low voltage limiting aperture situated at a field-free zone in the main focusing lens of an electron gun which avoids electron beam aberration, minimizes secondary electron emissions, does not adversely affect electron beam focusing, and intercepts the peripheral electrons at a relatively low energy to minimize grid thermal dissipation.

OBJECTS AND SUMMARY OF THE INVENTION

Accordingly, it is an object of the present invention to provide an electron beam in a CRT having a small, well defined spot size for improved video image quality.

Another object of the present invention is to provide an arrangement in the high voltage beam focusing region of an electron gun which provides a small beam spot size with minimum energy dissipation in the form of heat and minimizes secondary electrons incident on the display screen and the associated degradation of video image quality.

Yet another object of the present invention is to provide an essentially electrostatic field-free region in the high voltage beam focusing region of an electron lens with a small aperture forming a barrier to the peripheral rays of an electron beam bundle in limiting beam spot size for improved video image definition and focusing.

A further object of the present invention is to provide an energy efficient, small aperture arrangement for limiting the spot size of an electron beam in an electron focusing lens without producing spherical aberration.

Still another object of the present invention is to provide a relatively low voltage region with a small aperture in the main lens portion of an electron gun through which an electron beam is directed for intercepting outer electron beam rays and removing peripheral electrons from the beam to provide a small beam spot size on a CRT display screen.

It is another object of the present invention to charge a focusing electrode which intercepts outer electrons in an electron beam for limiting beam spot size on a display screen with a power supply separate and independent from the main electron gun accelerating and focusing power supplies for minimizing focus voltage shifts and resulting beam de-focusing.

These objects of the present invention are achieved and the disadvantages of the prior art are eliminated by a lens for focusing an electron beam comprised of energetic electrons emitted by a source along an axis toward a display screen, the lens comprising: a first low voltage focusing arrangement proximally disposed relative to the source on the axis for applying a first low voltage focusing electrostatic field to the energetic electrons for forming the energetic electrons into a beam; a second high voltage focusing arrangement disposed intermediate the first low voltage focusing arrangement and the display screen and on the axis for applying a high anode voltage $V_A$ and a large electrostatic field to the electron beam for respectively accelerating the electrons toward and focusing the electron beam on the display screen, the second high voltage focusing arrangement including a charged grid maintained at a voltage $V_G$ for providing a relatively electrostatic field-free region on the axis, where $V_G \leqq 0.12\ V_A$; and a limiting aperture disposed in the charged grid and on the axis in the relatively electrostatic field-free region for intercepting and removing electrons in a peripheral portion of the electron beam in reducing electron beam spot size on the display screen and the number of secondary electrons incident upon the display screen.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENTS

There are primarily three characteristics of an electrostatic focusing lens which determine the diameter, or spot size, of the electron beam incident upon the phosphorescing display screen of a CRT. The goal, of course, is to provide sharply defined, precisely focused electron beams incident on the display screen. The three primary characteristics of the electrostatic focusing lens are its magnification, spherical aberration and space charge effect.

The magnification factor is given by the following expression:

$$d_M = d_o M \frac{q}{p} \sqrt{\frac{V_o}{V_A}}\ d_o \tag{1}$$

where:

q=distance from the center of the main lens to display screen;

p=distance from the object plane to the center of the main lens;

$V_o$=voltage at the object side of the main lens;

$V_A$=voltage at the image side of the main lens; and $d_o$=object size.

The spherical aberration characteristic is given by the expression:

$$d_s = C_s\,\Theta^3 \tag{2}$$

where:

$C_s$=coefficient of spherical aberration; and $\Theta$=electron beam's divergence angle.

Electron beam spot size growth occurs due to the fact that a point source focused by a lens cannot again be focused to a point. The further away an electron ray is from the focusing lens optical axis, the larger the lens focusing strength preventing the electron ray from again being focused to a point source.

The space charge effect on electron beam spot size is given by the expression:

$$d_{sp}\ \alpha\Theta^{-1} \tag{3}$$

This growth factor in electron beam spot size arises from the repulsive force between like charged electrons.

Figure 1:
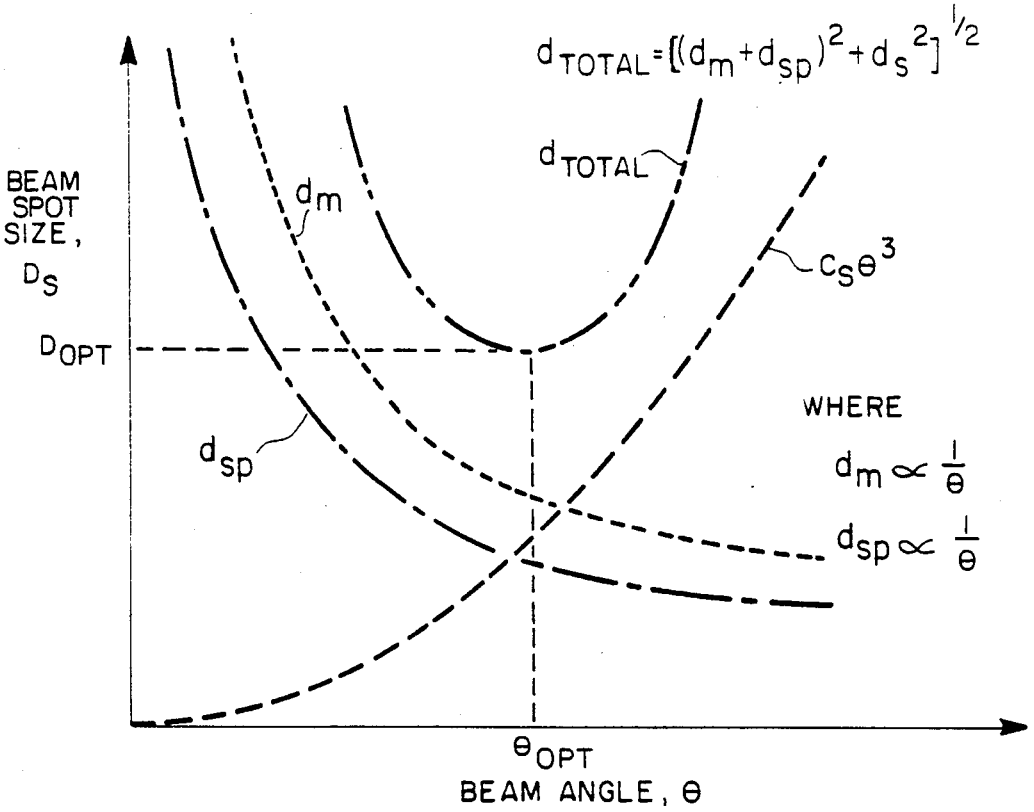
FIG. 1 shows the variation in electron beam spot size ($D_s$) with beam angle ($\Theta$), in terms of the three relevant factors of magnification ($d_M$), spherical aberration ($d_{sp}$), and space charge effect ($C_s\Theta^3$)
Figure 2:
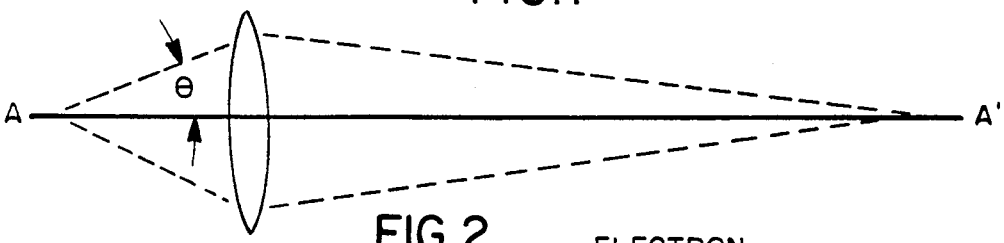
FIG. 2 is a simplified schematic diagram illustrating electron beam angle ($\Theta$) relative to the beam axis A—A'.

FIG. 1 shows the variation in electron beam spot size ($D_S$) with beam angle ($\Theta$), in terms of the three aforementioned factors of magnification ($d_M$), spherical aberration ($d_s$), and space charge effect ($d_{sp}$). With $d_{total}$ representing electron beam spot size with all three aforementioned factors included, it can be seen that $d_{total}$ is minimum at $\Theta_{opt}$ with $D_{opt}$. Beam angle $\Theta$ along the electron lens axis A—A' is shown in FIG. 2.

The electron beam is typically generated in a so-called beam forming region (BFR) of the electron gun. The BFR can be considered as an electron optical system separate from the electron gun's main lens for producing an electron beam bundle tailored to match the specific main lens of the electron gun.

Figures 3A, 3B:
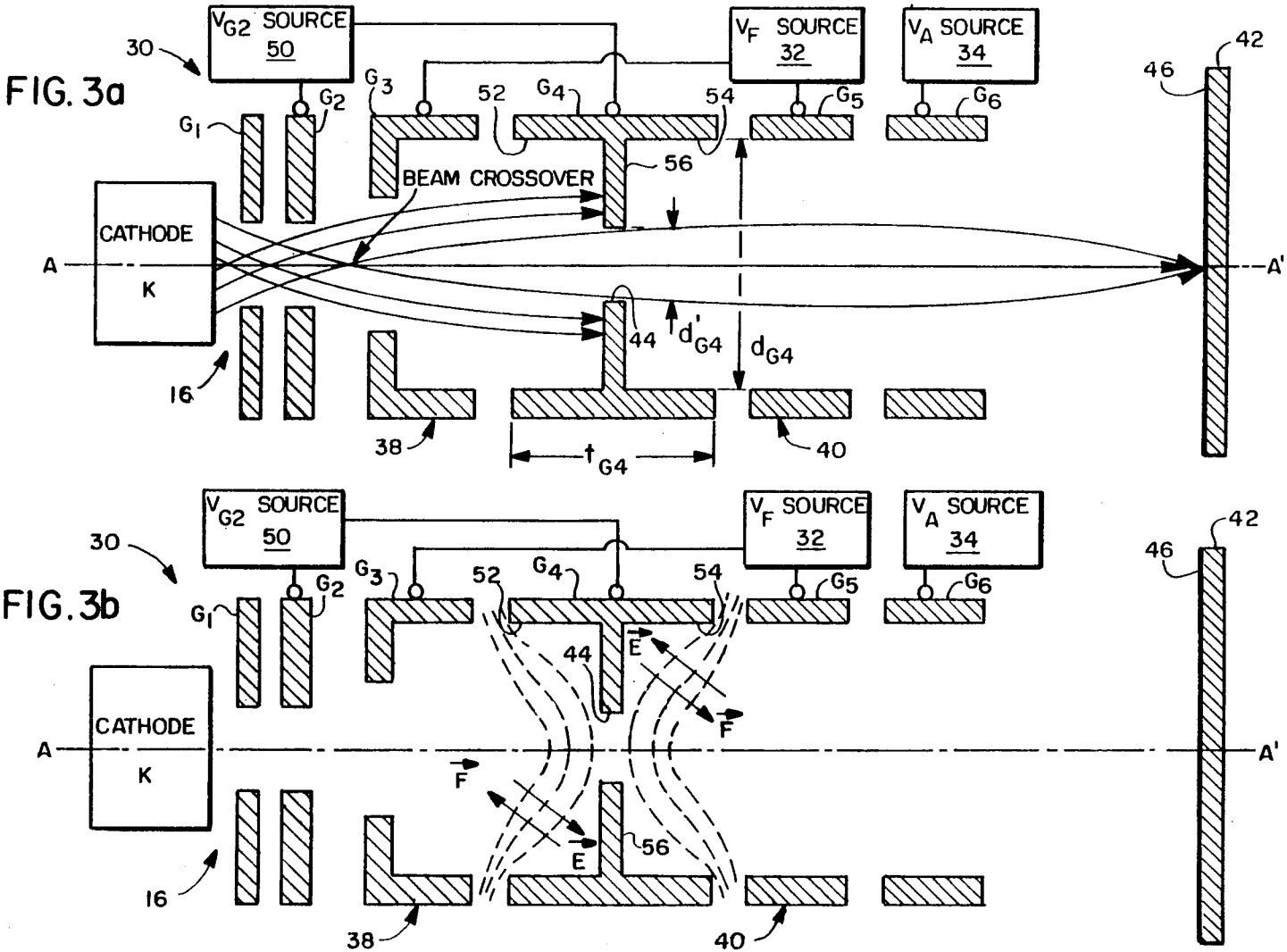
FIGS. 3*a* and 3*b* are simplified axial cross-sectional views of a focusing lens for an electron gun incorporating a limiting aperture in the beam focusing region thereof in accordance with one embodiment of the present invention, where FIGS. 3*a* and 3*b* respectively illustrate the location and configuration of electron beam ray and electrostatic field lines and forces applied to the electrons in the high voltage beam focusing region in accordance with this embodiment of the present invention.

Referring to FIGS. 3*a* and 3*b*, there is shown a simplified axial sectional view of an electron gun 30 incorporating a limiting aperture 44 in a high voltage "QPF-type" beam focusing lens 40 thereof in accordance with one embodiment of the present invention. In FIGS. 3*a* and 3*b* and other figures discussed below, common elements are assigned the same identifying number for simplicity and ease in describing the various embodiments of this invention. FIG. 3*a* also illustrates the distribution and location of electron beam rays within the electron gun 30, while FIG. 3*b* illustrates the shape and form of equipotential lines (shown in dotted-line form) as well as the electrostatic field $\vec{E}$ and electrostatic force $\vec{F}$ applied to the electrons in the beam within electron gun 30 in the vicinity of the limiting aperture 44. The electron gun 30 includes an electron beam source 16 which may be conventional in design and operation and typically includes a cathode K. Cathode K includes a sleeve, a heater coil and an emissive layer, all of which are deleted from the figures for simplicity. Electrons are emitted from the emissive layer of cathode K and are directed to a low voltage beam forming region (BFR) 38 and are focused to a first crossover along the axis of the beam A—A' by the effect of a grid commonly referred to as the $G_2$ screen grid. The $G_2$ screen grid is coupled to and charged by a $V_{G2}$ voltage source 50. A grid known as the $G_1$ control grid disposed between cathode K and the $G_2$ screen grid is operated at a negative potential relative to the cathode and serves to control electron beam intensity in response to the application of a video signal thereto, or to cathode K. A $G_1$ grid voltage source has been omitted from the figures for simplicity. The electron beam's first crossover is at a point where the electrons pass through the axis A—A' and is typically in the general vicinity of the $G_2$ screen grid and a $G_3$ grid. The terms "voltage" and "potential" are used interchangeably in the following paragraphs as are the terms "grid" and "electrode".

The $G_1$ control grid generally serves to control electrons emitted from cathode K and direct them in the general direction of the display screen 42. The $G_2$ screen grid serves to form the first crossover of the electron beam and to control electron beam intensity.

In addition to the $G_3$ grid, electron gun 30 further includes a $G_5$ grid, with these grids coupled to and charged by a focus voltage ($V_F$) source 32 in the embodiment shown in FIGS. 3*a* and 3*b*. Electron gun 30 further includes a $G_4$ grid which is disposed intermediate the $G_3$ and $G_5$ grids and is also coupled to and charged by the $V_{G2}$ voltage source 50. The electron gun 30 further includes a $G_6$ grid coupled to an electron accelerating anode voltage ($V_A$) source 34. The accelerating voltage $V_A$ is substantially higher than the focus voltage $V_F$ and serves to accelerate the electrons toward a display screen 42 having a phosphor coating 46 on the inner surface thereof. The focus voltage $V_F$ is typically 20–40% of the anode voltage $V_A$, with $V_A$ generally on the order of 25 kV and $V_F$ generally on the order of 7 kV.

Each of the grids is aligned with the electron beam axis A—A' and is coaxially disposed about the axis. Grids $G_1$, $G_2$ and $G_3$ are each provided with respective apertures aligned along the axis A—A' through which the energetic electrons pass as they are directed toward the display screen 42.

In accordance with the present invention, the $G_4$ grid is provided with a limiting aperture 44 and has an increased thickness, or length, along the beam axis A—A'. Limiting aperture 44 is generally circular and has a diameter of $d_{G4'}$. The thickness of the $G_4$ grid is given by $t_{G4}$.

The inventive $G_4$ grid further includes first and second outer recesses 52 and 54 disposed on opposed surfaces thereof and aligned along axis A—A'. The first and second outer recesses 52, 54 each have a diameter of $d_{G4}$, where $t_{G4} \geqq 1.8 d_{G4}$. In a preferred embodiment, $t_{G4} \geqq 5.4$ mm and $d_{G4} = 3$–$6$ mm. Disposed intermediate the first and second outer recesses 52, 54 is an inner partition 56 defining the limiting aperture 44. In a preferred embodiment, the diameter $d_{G4'}$ of the limiting aperture 44 is 10–50% of the diameter $d_{G4}$ of the first and second outer recesses 52, 54 of the $G_4$ grid. The first and second outer recesses 52, 54 define respective facing recessed portions of the $G_4$ grid which cause the electrostatic field to be reduced essentially to zero within the grid along axis A—A' in the vicinity of the limiting aperture 44. Limiting aperture 44 limits electron beam spot size as described in the following paragraphs. As previously described, the $G_2$ screen grid and the limiting aperture $G_4$ grid are coupled to and charged by the $V_{G2}$ voltage source 50, where $500\ V \leqq V_{G2} \leqq 0.12\ V_A$ in a preferred embodiment.

Referring to FIG. 3*b*, there is shown a sectional view of the electron gun 30 illustrating the location and configuration of equipotential lines as well as electrostatic fields and forces applied to the electrons in the high voltage beam focusing lens 40 in accordance with the present invention. Equipotential lines are shown in dotted-line form adjacent the $G_4$ grid, and in particular adjacent the limiting aperture 44 in the $G_4$ grid. From the figure, it can be seen that the recessed portions of the $G_4$ grid formed by the first and second outer recesses 52, 54 adjacent the limiting aperture 44 form equipotential lines which bend inwardly toward the limiting aperture. Because the thickness of the $G_4$ grid $t_{G4}$ is such that $t_{G4} \geqq 1.8 d_{G4}$, the equipotential lines are essentially zero in the immediate vicinity of limiting aperture 44. The electrostatic field, represented by the field vector $\vec{E}$, applies a force represented by the force vector $\vec{F}$ to the electrons, where $\vec{F} = -e\vec{E}$. An electrostatic field is formed between two charged electrodes, where $G_3$ and $G_5$ disposed on opposed sides of the $G_4$ grid along electron gun axis A—A' are operated at a focusing voltage $V_F$ which is at least ten (10) times that of $V_{G2}$ in a preferred embodiment.

As shown in FIG. 3*b*, the electrostatic field $\vec{E}$ is aligned transverse to the equipotential lines, as is the electrostatic force $\vec{F}$, which is opposite in direction to the electrostatic field lines $\vec{E}$ because of the negative electron charge. As the electron beam traverses the space between the $G_3$ and $G_4$ grids, it experiences a diverging force as shown by the direction of the force vector $\vec{F}$. This diverging force field causes a limited dispersal of the electrons within the beam to reduce beam space charge effect. A portion of the outer periphery of the electron beam strikes the inner portion of the $G_4$ grid defining the limiting aperture 44 to cut off the outer periphery of the electron beam. This limits beam spot size as the electron beam transits the $G_4$ grid and proceeds toward the $G_5$ grid. Intermediate the $G_4$ and $G_5$ grids, the electrostatic field vector $\vec{E}$ is again directed toward the electrode with the lower voltage, i.e., the $G_4$ grid, while the force vector $\vec{F}$ is directed toward the electrode maintained at the greater potential because of the electron's negative charge. Thus, as the electrons transit the space between the $G_4$ and $G_5$ grids, they are subjected to a converging force which operates with the focus voltage $V_F$ to converge the electron beam rays in the form of a small spot on the display screen's phosphor coating 46.

In accordance with the present invention, the $G_4$ grid is provided with thickness $t_{G4}$. The thickness $t_{G4}$ along the axis A—A' in combination with the extended first and second outer recesses 52, 54 on facing surfaces of the $G_4$ grid form a substantially electrostatic field-free region in the center of the $G_4$ grid at the limiting aperture 44. With the electrostatic field essentially zero in the vicinity of the $G_4$ inner partition 56, the secondary electrons emitted from the $G_4$ inner partition as a result of energetic electrons incident thereon are not directed toward the display screen 42. Without the influence of an electrostatic field, these secondary electrons tend to remain in the vicinity of the limiting aperture 44 until absorbed by the $G_4$ or $G_5$ grid. Secondary electrons are thus essentially eliminated from the electron beam incident upon the display screen 42. Elimination of these secondary electrons which cause a loss of contrast and/or loss of purity improves the quality of the video image. The small diameter $d_{G4'}$ of limiting aperture 44 further reduces the secondary electrons from the $G_4$ grid to reach the display screen 42. Prior art approaches have required a large aperture in the main focusing lens because of the increased beam cross-section in this portion of the electron gun. This large aperture has not only had limited effect in reducing beam spot size, but has also allowed a substantial number of secondary electrons to reach the display screen and degrade the video image.

Figure 4:
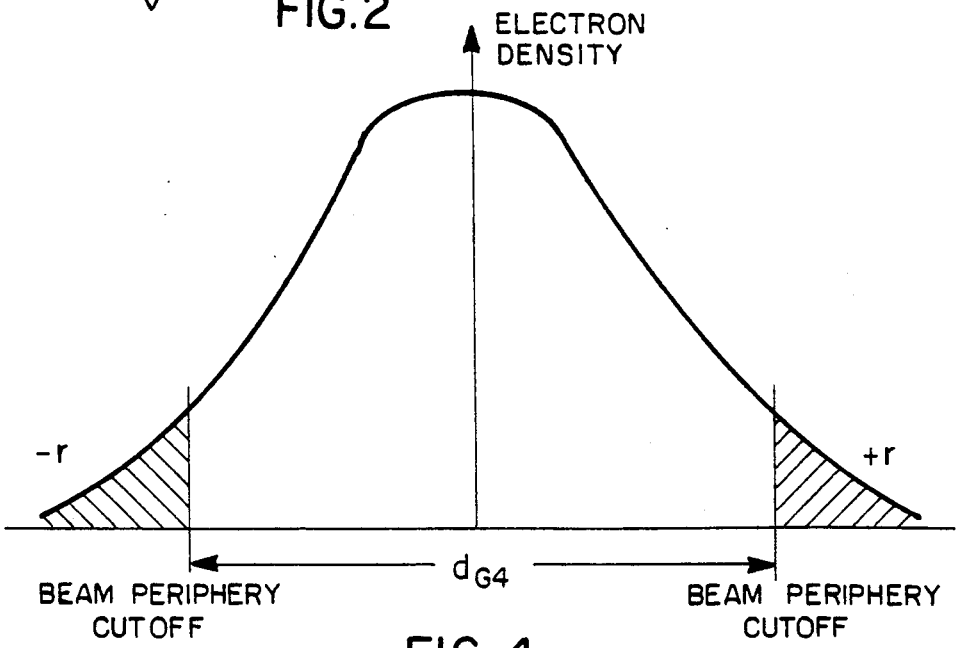
FIG. 4 is a graphic illustration of the Gaussian distribution of electrons in an electron beam and the manner in which the limiting aperture of the present invention removes outer electrons from the beam to provide a small electron beam spot size.

Referring to FIG. 4, there is shown a graphic illustration of the Gaussian distribution of electrons in an electron beam and the cut-off of outer electron rays by the limiting aperture 44 of the present invention to form a small electron beam spot size. Because the limiting aperture 44 of the $G_4$ grid is disposed in a field-free region, the limiting aperture does not have a lens effect on the electron beam and does not produce undesirable spherical aberration. Where a limiting aperture is disposed in an electrostatic field region, the electrons are affected by electrostatic field gradients resulting in spherical aberration of the electron beam spot on the inner surface of the display screen. Because limiting aperture 44 is in an essentially field-free region, the portion of the $G_4$ grid defining the limiting aperture, i.e., the $G_4$ inner partition 56, does not electrostatically interact with the electrons, but merely presents a physical barrier to electron rays in the outer periphery of the electron beam. As shown in FIG. 4, electron rays disposed beyond, or outside of, limiting aperture with a diameter of $d_{G4}$ are eliminated from the electron beam.

Figure 5A:
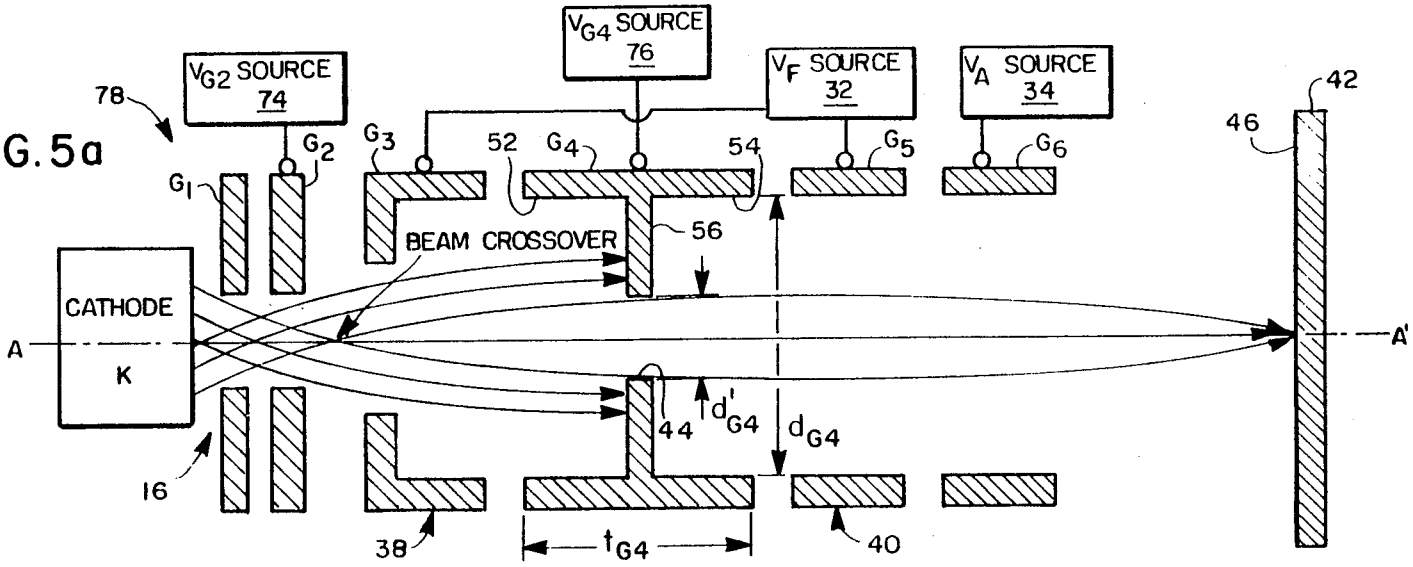
FIGS. 5*a* and 5*b* are simplified axial cross-sectional views of a focusing lens for an electron gun incorporating a limiting aperture in the beam focusing region thereof in accordance with another embodiment of the present invention, where FIGS. 5*a* and 5*b* respectively illustrate the location and configuration of electron beam rays and electrostatic field lines and forces applied to the electrons in the high voltage beam focusing region in accordance with this embodiment of the present invention.
Figure 5B:
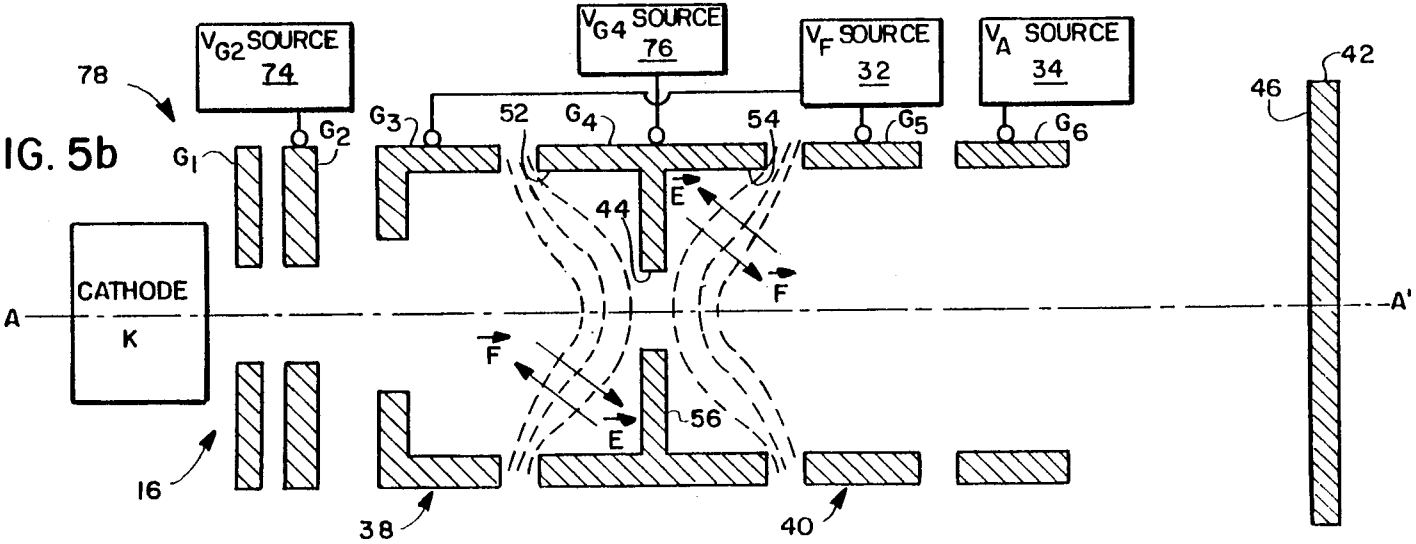

Referring to FIGS. 5*a* and 5*b*, there is shown an axial sectional view of an electron gun 78 in accordance with another embodiment of the present invention. FIG. 5*a* illustrates the electron beam rays, while FIG. 5*b* illustrates the equipotential lines within the electron gun 78. Electron gun 78 differs from the electron gun shown in FIGS. 3*a* and 3*b* in that the $G_2$ screen grid is coupled to a $V_{G2}$ voltage source 74, while the $G_4$ grid is coupled to and charged by a separate $V_{G4}$ voltage source 76. In the embodiment of FIG. 5*a* and 5*b*, the $G_2$ and $G_4$ grids are thus charged by separate and independent voltage sources, or power supplies. With the $V_{G4}$ voltage source 76 independent of the $V_{G2}$ voltage source 74, electrons intercepted by the $G_4$ inner partition 56 defining the limiting aperture 44 are prevented from flowing through the resistor chain and affecting the beam cutoff characteristics of the low voltage BFR 38. In this embodiment, $300\ V \leqq V_{G4} \leqq 0.12\ V_A$.

Figure 6A:
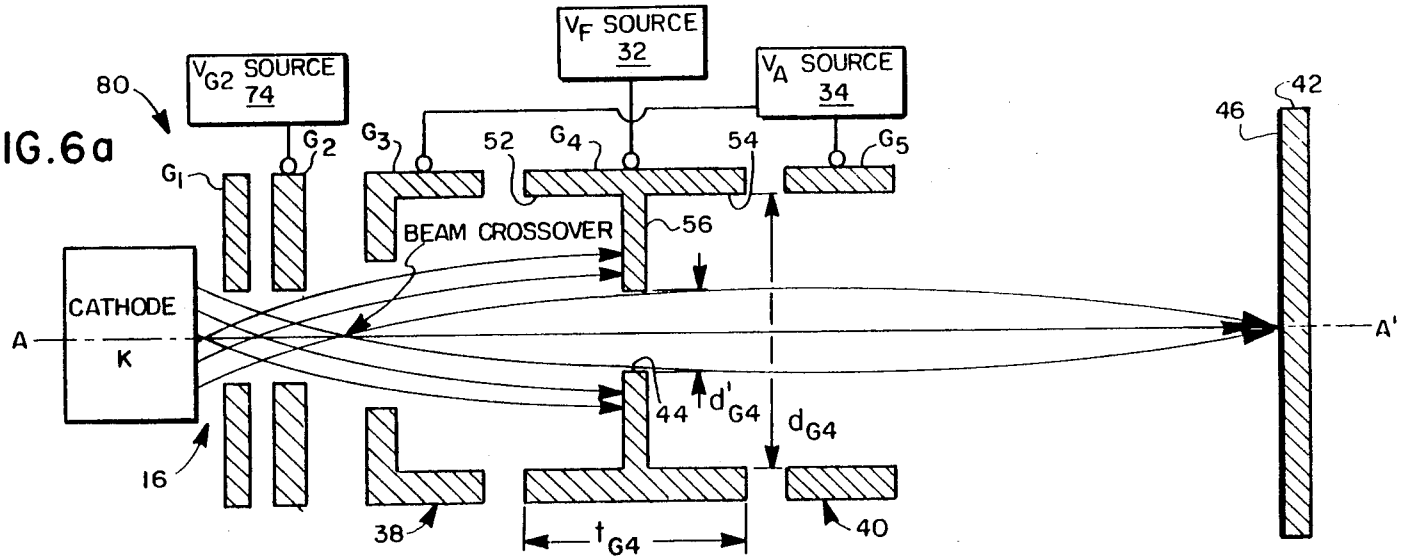
FIGS. 6*a* are 6*b* are simplified axial cross-sectional views of a focusing lens for an electron gun incorporating a limiting aperture in the beam focusing region thereof in accordance with yet another embodiment of the present invention, where FIGS. 6*a* and 6*b* respectively illustrate the location and configuration of electron beam rays and electrostatic field lines and forces applied to the electrons in the high voltage beam focusing region in accordance with this embodiment of the present invention.
Figure 6B:
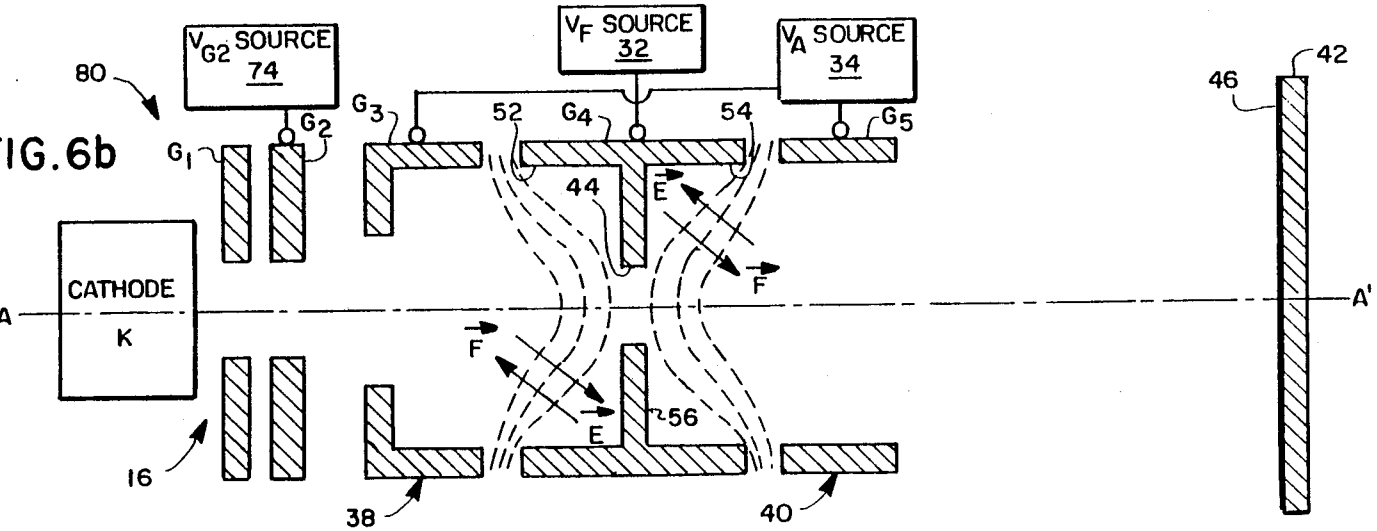

Referring to FIGS. 6*a* and 6*b*, there is shown an Einzel-type electron gun 80 in accordance with yet another embodiment of the present invention. As in the previously described embodiments, the $G_4$ grid is generally cylindrical shaped, with its lengthwise axis aligned along the axis A—A' of electron gun 80. The thickness of the $G_4$ grid along the axis A—A' is $t_{G4}$. The $G_4$ grid in the embodiment of FIGS. 6*a* and 6*b* also includes an inner partition 56 defining a limiting aperture 44. In this embodiment, the $G_2$ screen grid is coupled to and charged by a separate $V_{G2}$ voltage source 74. Similarly, the $G_4$ grid is coupled to and charged by a separate focusing voltage $V_F$ source 32. In some electron guns there may be more than one focusing voltage $V_F$ source, with $V_F$ ranging from 100 V to as much as 10,000 V, or more. A higher anode voltage $V_A$ charges the $G_3$ and $G_5$ grids by means of a $V_A$ voltage source 34 coupled thereto. As in the previous embodiments, $300\ V \leqq V_{G4} \leqq 0.12\ V_A$ and the depth of the first and second recessed slots 52, 54 in facing surfaces of the $G_4$ grid provides an essentially electrostatic field-free region in the vicinity of the limiting aperture 44. This field-free region eliminates a lens effect of the limiting aperture 44 on the electron beam and undesirable spherical aberration associated therewith. Because the limiting aperture 44 is in an essentially electrostatic field-free region, inner partition 56 does not electrostatically interact with the electrons, but merely presents a physical barrier to electron rays about the periphery of the electron beam for intercepting and removing peripheral electrons from the beam and reducing electron beam spot size.

Figures 7A, 7B:
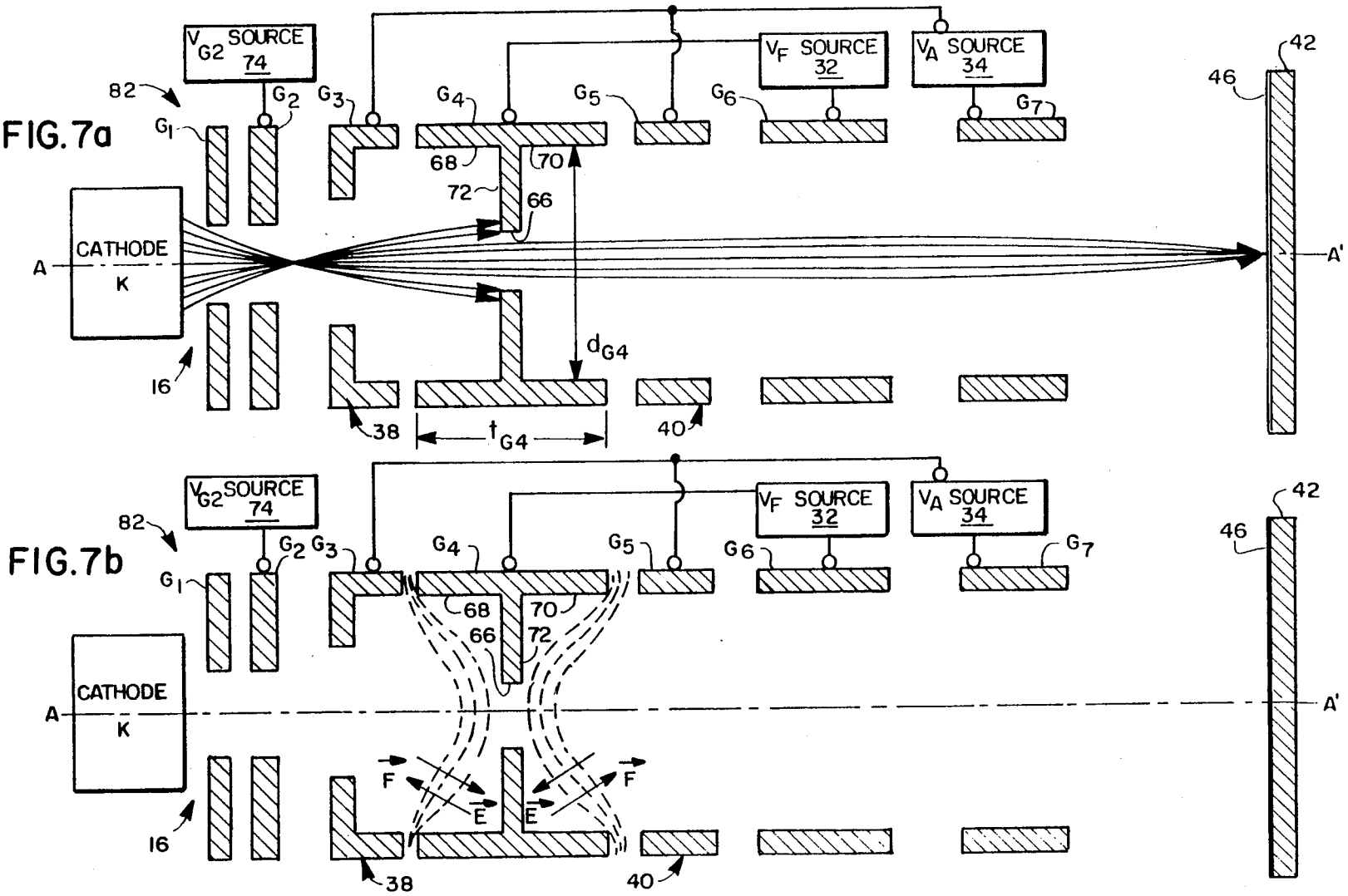
FIGS. 7*a* and 7*b* are simplified axial cross-sectional views of a focusing lens for an electron gun incorporating a limiting aperture in the beam focusing region thereof in accordance with yet another embodiment of the present invention, where FIGS. 7*a* and 7*b* respectively illustrate the location and configuration of electron beam rays and electrostatic field lines and forces applied to the electrons in the high voltage beam focusing region in accordance with this embodiment of the present invention.

Referring to FIGS. 7*a* and 7*b*, there are shown axial sectional views of yet another embodiment of an electron gun 82 in accordance with the principles of the present invention. In the embodiment of FIGS. 7*a* and 7*b*, the $G_4$ grid in the electron gun 82 includes an inner partition 72 defining a limiting aperture 66 along the axis A—A' of the electron gun. A focusing voltage $V_F$ source 32 is coupled to the $G_6$ grid as well as to the $G_4$ grid. A higher anode voltage $V_A$ is provided to the $G_3$, $G_5$ and $G_7$ grids by a $V_A$ voltage source 34 coupled thereto. A separate $V_{G2}$ voltage source 74 is coupled to and charges the $G_2$ screen grid. FIG. 7*a* shows the position and configuration of electron beam rays within electron gun 82, with the outer electron beam rays intercepted by the inner partition 72 of the $G_4$ grid adjacent to the limiting aperture 66. Inner partition 72 separates facing outer recessed portions 68, 70 of the $G_4$ grid. FIG. 7*b* shows in dotted-line form equipotential lines in the vicinity of the limiting aperture 66 in the $G_4$ grid. Also shown are the electrostatic field $\vec{E}$ and electrostatic force $\vec{F}$ exerted on the electrons in the vicinity of the $G_4$ grid. As in the previous embodiments, electrons approaching the $G_4$ grid experience a diverging force away from axis A—A' to reduce the space charge effect within the beam. This allows for an increasing number of peripheral rays in the electron beam to be intercepted by the inner partition 72 defining the limiting aperture 66. Following passage of the electron beam through the limiting aperture 66, a converging electrostatic force $\vec{F}$ is exerted on the electrons as they are focused on the phosphor coating 46 on the display screen 42 for minimizing electron beam spot size.

Figure 8:
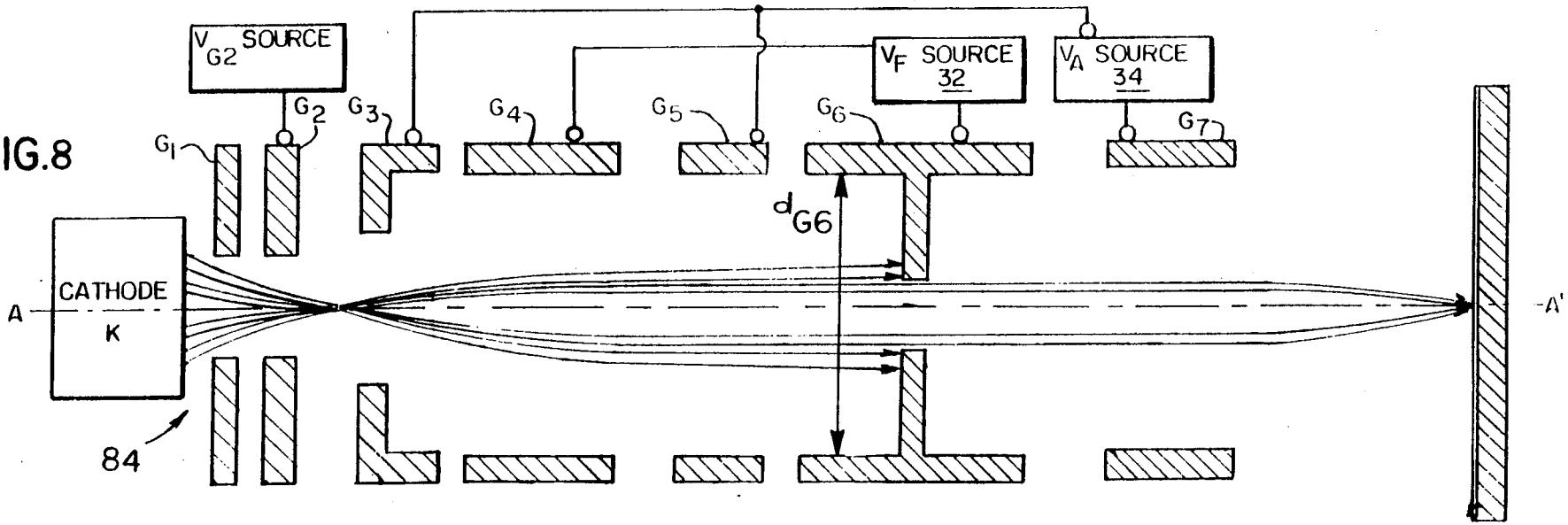
FIG. 8 is a simplified axial cross-sectional view of a focusing lens for an electron gun incorporating a limiting aperture in the $G_6$ grid in the high voltage focusing region in accordance with another embodiment of the present invention.

Referring to FIG. 8, there is shown a simplified axial sectional view of an electron gun 84 incorporating a limiting aperture in the $G_6$ grid in the high voltage focusing region in accordance with another embodiment of the present invention.

There has thus been shown various embodiments of an electron gun incorporating a limiting aperture disposed in a relatively electrostatic field-free region in the high voltage main focusing lens portion of the electron gun. The generally circular limiting aperture is disposed on the axis of the electron gun and within a charged electrode, or grid, within the main focusing lens. The limiting aperture is disposed intermediate a pair of generally circular recessed portions in facing surfaces of the charged electrode which has an increased thickness $t_G$ along the electron gun axis, where the circular recessed portions have a diameter $d_G$ and $t_G \geqq 1.8 d_G$. The limiting aperture-bearing grid is maintained at a voltage $V_G$ which is much less than that of the electron gun's accelerating anode voltage $V_A$, where $V_G \leqq 0.12\ V_A$. With the limiting aperture recessed within the cylindrically shaped, elongated charged electrode, the electrostatic field is essentially zero at the limiting aperture where outer, peripheral electrons in the electron beam are intercepted for limiting electron beam spot size. The low voltage of the limiting aperture grid and the small size of the limiting aperture substantially reduces the possibility of secondary electrons reaching the display screen and virtually eliminates the "haze" about video images on the display screen associated therewith.

While particular embodiments of the present invention have been shown and described, it will be obvious to those skilled in the art that changes and modifications may be made without departing from the invention in its broader aspects. For example, while the limiting aperture-bearing, low voltage grid has been disclosed as the $G_4$ or $G_6$ grids, it is not limited to these specific grids, but may be any of the grids in the main focusing lens portion of the electron gun. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A lens for focusing an electron beam comprised of energetic electrons emitted by a source along an axis toward a display screen, said lens comprising:

first low voltage focusing means proximally disposed relative to said source on said axis for applying a first low voltage focusing electrostatic field to the energetic electrons for forming the energetic electrons into a beam;

second high voltage focusing means disposed intermediate said first low voltage focusing means and said display screen and on said axis for applying a high anode voltage $V_A$ and a large electrostatic field to the electron beam for respectively accelerating the electrons toward and focusing the electron beam on the display screen, said second high voltage focusing means including charged grid means having a thickness $t_G$ along said axis and maintained at a voltage $V_G$ for providing a relatively electrostatic field-free region on said axis, where $V_G \leqq 0.12\ V_A$; and means defining a limiting aperture disposed in said charged grid means and on said axis in said relatively electrostatic field-free region for intercepting and removing electrons in a peripheral portion of the electron beam in reducing electron beam spot size on the display screen and the number of secondary electrons incident upon the display screen, wherein said limiting aperture is generally circular having a diameter $d_{G'}$, and $t_G > d_{G'}$.

2. The lens of claim 1 wherein said grid means includes first and second recessed portions extending inwardly from opposed facing surfaces of said grid means aligned along said axis and separated by said means defining said limiting aperture.

3. The lens of claim 2 wherein said grid means further includes an inner partition defining said limiting aperture and separating said first and second recessed portions.

4. The lens of claim 3 wherein each of said first and second recessed portions is generally circular and has a diameter $d_G$, where $t_G \geqq 1.8\ d_G$.

5. The lens of claim 4 wherein $t_G \geqq 5.4$ mm and $d_G = 3$–$6$ mm.

6. The lens of claim 4 wherein $d_{G'} = 10$–$50\%\ d_G$.

7. The lens of claim 1 wherein $V_G \geqq 300$ V.

8. The lens of claim 1 wherein the source of electrons includes a cathode K and said first low voltage focusing means includes a charged $G_1$ control grid and a charged $G_2$ screen grid, wherein raid $G_1$ control grid is disposed intermediate said cathode and said $G_2$ screen grid.

9. The lens of claim 8 wherein said charged grid means comprises a $G_4$ grid disposed intermediate said $G_2$ grid and said display screen.

10. The lens of claim 9 further comprising a $G_3$ grid disposed intermediate said $G_2$ and $G_4$ grids and a $G_5$ grid disposed intermediate said $G_4$ grid and said display screen.

11. The lens of claim 10 further comprising a $G_6$ grid disposed intermediate said $G_5$ grid and said display screen.

12. The lens of claim 11 wherein said $G_2$ and $G_4$ grids are coupled to and charged to a voltage $V_G$ by a first voltage source.

13. The lens of claim 12 wherein said $G_3$ and $G_5$ grids are coupled to and charged to a voltage $V_F$ by a focus voltage $V_F$ source.

14. The lens of claim 13 wherein said $G_6$ grid is coupled to and charged to a voltage $V_A$ by an anode voltage $V_A$ source.

15. The lens of claim 11 wherein said $G_2$ and $G_4$ grids are coupled to and charged by respective first and second voltage sources.

16. The lens of claim 15 wherein said $G_3$ and $G_5$ grids are coupled to and charged by a common focus voltage $V_F$ source and said $G_6$ is coupled to and charged by an anode voltage $V_A$ source.

17. The lens of claim 10 wherein said $G_4$ grid is coupled to and charged to a focus voltage $V_F$ by a focus voltage $V_F$ source.

18. The lens of claim 17 wherein said $G_3$ grid is coupled to and charged to an anode voltage $V_A$ by an anode voltage $V_A$ source.

19. The lens of claim 10 wherein said charged grid means includes a $G_6$ grid disposed intermediate said $G_5$ grid and said display screen, and wherein said lens further includes a $G_7$ grid disposed intermediate said $G_6$ grid and said display screen.

20. The lens of claim 19 wherein said $G_4$ and $G_6$ grids are coupled to and charged to a focus voltage $V_F$ by a focus voltage $V_F$ source.

21. The lens of claim 20 wherein said $G_3$, $G_5$ and $G_7$ grids are coupled to and charged to an anode voltage $V_A$ by an anode voltage $V_A$ source.

22. An electron gun for a cathode ray tube, comprising:

cathode means for generating energetic electrons;

low voltage beam forming means disposed adjacent said cathode means for receiving said energetic electrons and forming an electron beam with a beam crossover on a longitudinal axis of the electron gun toward a display screen;

high voltage focusing means disposed intermediate said low voltage beam forming means and said display screen and on said axis for receiving said electron beam at said beam crossover and for applying a high anode voltage $V_A$ and a large electrostatic field to the electron beam for respectively accelerating the electrons toward and focusing the electron beam on the display screen, said second high voltage focusing means including charged grid means having a thickness $t_G$ along said axis and maintained at a voltage $V_G$ for providing a relatively electrostatic field-free region on said axis, where $V_G \leqq 0.12\ V_A$; and means defining a limiting aperture disposed on the longitudinal axis of the electron gun in the relatively field-free region of said beam forming means for removing electrons disposed about the periphery of said electron beam in reducing electron beam cross-section and electron beam spot size on said display screen, wherein said limiting aperture is generally circular and has a diameter $d_{G'}$, where $t_G > d_{G'}$.

23. The electron gun of claim 22 wherein said charged grid means includes first and second recessed portions extending inwardly along said axis from opposed facing surfaces of said charged grid means and said charged grid means further includes a thin wall separating said first and second recessed portions and including said means defining said limiting aperture.

24. The electron gun of claim 23 wherein each of said first and second recessed portions is generally circular having a diameter $d_G$, where $t_G \geqq 1.8\ d_G$.

25. The electron gun of claim 24 wherein $t_G \geqq 5.4$ mm and $d_G = 3$–$6$ mm.

26. The electron gun of claim 24 wherein $d_{G'} = 10$–$50\%\ d_G$.

27. The electron gun of claim 22 wherein said charged grid means ia a $G_4$ grid.

28. The electron gun of claim 22 wherein said charged grid means ia a $G_6$ grid.

29. The electron gun of claim 22 further comprising a first lower voltage power supply coupled to said charged grid means and a second higher voltage power supply coupled to said high voltage focusing means.

30. A lens for focusing an electron beam comprised of energetic electrons emitted by a source along an axis and accelerated by a voltage $V_A$ toward a display screen, said lens comprising:

first low voltage focusing means proximally disposed relative to said source on said axis for applying a first focusing electrostatic field to the energetic electrons for forming the energetic electrons into a beam;

second high voltage focusing means disposed intermediate said first low voltage focusing means and said display screen and on said axis for focusing the electron beam on the display screen;

a generally cylindrical shaped charged grid in said second high voltage focusing means having a thickness $t_G$ aligned along said axis and including first and second generally circular recessed portions located in facing surfaces of said charged grid and aligned along said axis so as to form a relatively electrostatic field-free region in said charged grid, wherein each of said recessed portions has a diameter $d_G$ and said charged grid is maintained at a voltage $V_G$, where $V_G \leqq 0.12\ V_A$; and means defining a limiting aperture on said axis in the relatively electrostatic field-free region of said charged grid for removing electrons in a peripheral portion of the electron beam in reducing electron beam spot size on the display screen, wherein said limiting aperture has a diameter $d_{G'}$, where $d_{G'} = 10$–$50\%\ d_G$.

* * * * *

UNITED STATES PATENT AND TRADEMARK OFFICE

CERTIFICATE OF CORRECTION

PATENT NO. : 5,223,764

DATED : June 29, 1993

INVENTOR(S) : Hsing-Yao Chen

It is certified that error appears in the above-indentified patent and that said Letters Patent is hereby corrected as shown below:

| Column: | Line: | |
|---|---|---|
| 1 | 16 | After "sections", insert --:--. |
| 3 | 32 | Delete "ray" and insert --rays-- therefor. |
| 10 | 32 | Delete "raid" and insert --said-- therefor. |
| 12 | 9 | Delete "ia" and insert --is-- therefor. |

Signed and Sealed this

Fifth Day of April, 1994

Bruce Lehman

*Attest:*

BRUCE LEHMAN

*Attesting Officer*

*Commissioner of Patents and Trademarks*